US012234825B2

(12) United States Patent
Mathys et al.

(10) Patent No.: US 12,234,825 B2
(45) Date of Patent: Feb. 25, 2025

(54) ELEMENT FOR COMPRESSING A GAS AND METHOD FOR CONTROLLING SUCH ELEMENT

(71) Applicant: ATLAS COPCO AIRPOWER, NAAMLOZE VENNOOTSCHAP, Wilrijk (BE)

(72) Inventors: Wim Mathys, Wilrijk (BE); Luc Van Mieghem, Wilrijk (BE); Daniele Pettinari, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 18/287,373

(22) PCT Filed: May 13, 2022

(86) PCT No.: PCT/EP2022/063056
§ 371 (c)(1),
(2) Date: Oct. 18, 2023

(87) PCT Pub. No.: WO2022/248252
PCT Pub. Date: Dec. 1, 2022

(65) Prior Publication Data

US 2024/0376894 A1 Nov. 14, 2024

(30) Foreign Application Priority Data

May 27, 2021 (BE) ..... 2021/5426

(51) Int. Cl.
*F04C 28/24* (2006.01)
*F04C 18/16* (2006.01)

(52) U.S. Cl.
CPC ..... *F04C 28/24* (2013.01); *F04C 18/16* (2013.01); *F04C 2240/30* (2013.01)

(58) Field of Classification Search
CPC ..... F04C 28/24; F04C 28/12; F04C 18/16; F04C 18/0215; F04C 18/0261;
(Continued)

(56) References Cited

U.S. PATENT DOCUMENTS 4,580,950 A * 4/1986 Sumikawa ..... F04C 28/24 417/295
4,878,818 A 11/1989 Shaw
(Continued)

FOREIGN PATENT DOCUMENTS

DE 198 00 711 A1 7/1999
JP 61-65087 A 4/1986
WO 2011/066817 A2 6/2011

OTHER PUBLICATIONS

International Search Report of PCT/EP2022/063056 dated Sep. 14, 2022 [PCT/ISA/210].
(Continued)

*Primary Examiner* — Dapinder Singh
(74) *Attorney, Agent, or Firm* — Sughrue Mion, PLLC

(57) ABSTRACT

An element for compressing a gas with a housing (2) which encloses a compression chamber (5) with an outlet port (7) connected to the outlet. A rotor (8) is mounted so that the compression chamber (5) is divided into working chambers. A passage (10) extends between the outlet and a working chamber in the compression chamber (5) which is not in adjacent contact with the outlet port (7). The passage has an overpressure valve (11) to open the passage when a pressure difference between the working chamber and the outlet (4) exceeds a preset value. A valve body (12) encloses a buffer space (13) with a variable volume that is in fluid connection with the outlet through a constriction (14), so the volume is reduced and gas from the buffer space (13) flows through the constriction (14) to the outlet upon opening the passage (10).

19 Claims, 2 Drawing Sheets

(58) Field of Classification Search
CPC ..... F04C 23/008; F04C 29/00; F04C 29/12; F04C 29/028; F04C 29/124; F04C 15/06; F04C 2/16; F04C 2240/30; F04C 2240/20
See application file for complete search history.

(56) References Cited

U.S. PATENT DOCUMENTS

| | | | | |
|---|---|---|---|---|
| 5,411,375 | A | 5/1995 | Bauer | |
| 5,653,585 | A * | 8/1997 | Fresco | F25B 1/047 418/94 |
| 5,674,063 | A | 10/1997 | Ozaki et al. | |
| 5,871,338 | A | 2/1999 | Abelen et al. | |
| 7,607,902 | B2 * | 10/2009 | Onoda | F01C 21/0863 417/310 |
| 2005/0235670 | A1 * | 10/2005 | Takeuchi | F01C 11/008 62/323.1 |
| 2012/0039737 | A1 | 2/2012 | Birch et al. | |
| 2015/0192127 | A1 * | 7/2015 | Nagano | F04C 28/24 417/410.5 |
| 2019/0219055 | A1 * | 7/2019 | Kim | F04C 27/005 |

OTHER PUBLICATIONS

Written Opinion of PCT/EP2022/063056 dated Sep. 14, 2022 [PCT/ISA/237].

* cited by examiner

ELEMENT FOR COMPRESSING A GAS AND METHOD FOR CONTROLLING SUCH ELEMENT

CROSS REFERENCE TO RELATED APPLICATIONS

This application is a National Stage of International Application No. PCT/EP2022/063056 filed on May 13, 2022, claiming priority based on Belgium Patent Application No. 2021/5426 filed on May 27, 2021.

BACKGROUND OF THE INVENTION

1. Field of the Invention

The present invention relates to an element for compressing a gas and a method for controlling such an element.

More specifically, the invention relates to an element for compressing a gas with a housing that encloses a compression chamber, wherein the compression chamber is divided by a rotor into successive working chambers, wherein the element is provided with a first passage between an outlet of the element for compressed gas and a first working chamber in the compression chamber, which first working chamber is in such a first position that it is not in adjacent contact with an outlet port of the compression chamber, and wherein the first passage is provided with an overpressure valve for opening the first passage when a pressure in the first working chamber in said first position exceeds a first preset value.

2. Background

An element for compressing a gas wherein the compression chamber is divided by a rotor into successive working chambers, also referred to as an element of the rotating positive displacement type, generally operates according to the principle that on rotation of the rotor repeatedly a working chamber in the compression chamber successively

- is created at the inlet port of the compression chamber;
- subsequently moves into a direction from the inlet port to the outlet port and draws in gas from the inlet port;
- on further rotation of the rotor the fluid contact with the inlet port terminates at a certain moment; and
- eventually enters into adjacent contact with the outlet port and discharges compressed gas from the compression chamber through the outlet port.

In some types of elements of the rotating positive displacement type, such as screw compressor elements or screw vacuum pump elements, a total volume of the working chamber is reduced between the moment when the fluid contact with the inlet port is terminated and the moment when the working chamber enters into adjacent contact with the outlet port.

Such a volume reduction causes an internal pressure to increase in the working chamber in the compression chamber.

Hereby, an internal pressure ratio in the compression chamber is determined by the reduced total volume of the working chamber at a moment directly before the working chamber enters into adjacent contact with the outlet port.

In this context, 'internal pressure ratio in the compression chamber' refers to a ratio of a pressure at the outlet port of the compression chamber and a pressure at the inlet port of the compression chamber.

However, this internal pressure increase does not always correspond to a desired pressure ratio across the element.

In this context, 'pressure ratio across the element' refers to a ratio of pressure at an outlet of the element for compressed gas and a pressure at an inlet of the element for the gas.

Making abstraction of pressure losses on the one hand between the inlet of the element and the inlet port of the compression chamber and on the other hand between the outlet of the compression chamber and the outlet of the element, manifests the non-correspondence of the internal pressure increase to the desired pressure increase as follows:

- an overcompression of the gas in the event that the internal pressure ratio in the compression chamber is higher than the desired pressure ratio across the element;
- an undercompression of the gas in the event that the internal pressure ratio in the compression chamber is lower than the desired pressure ratio across the element.

If the gas can only enter or leave the compression chamber of the element through the inlet port or the outlet port, respectively, the internal pressure ratio is, moreover, fixed by the internal geometry of the rotor and of the compression chamber with the inlet port and the outlet port.

However, the pressure ratio across the element is not fixed and depends on ambient factors of the element.

For instance, in the case of a compressor element, a pressure of the gas at the inlet of the element is usually fixed at an ambient atmospheric pressure of the element, but a pressure of the compressed gas at the outlet may vary in accordance with requirements of a user of the compressed gas as regards the pressure of the compressed gas.

In the case of a vacuum pump element, the pressure of the compressed gas at the outlet of the element is usually fixed at an ambient atmospheric pressure of the element, but the pressure of the gas at the inlet may vary in accordance with requirements of a user as regards a usually subatmospheric pressure in a space connected to the inlet of the vacuum pump element.

Consequently, dependent on said ambient factors of the element, overcompression or undercompression may exist for the same element.

Said ambient factors of the element may also vary over time, which means that for instance even a situation may develop in which at a first moment overcompression exists and, on the other hand, at a different, second moment undercompression exists.

Overcompression has the disadvantage that the gas is compressed too strongly, which means that energy is wasted to compress the gas.

Moreover, on overcompression the gas is subjected in the compression chamber to a sudden and possibly strong pressure drop at the outlet port, which may cause shocks and damages to the element associated therewith.

JP S61-65087 A, U.S. Pat. No. 5,674,063 A and US 2012/0039737 A1 describe a screw vacuum pump element provided with a passage with an overpressure valve between an ambient atmosphere of the element and a first working chamber in the compression chamber of the screw vacuum pump element, which first working chamber is in such a first position that is not yet in adjacent contact with the outlet port of the compression chamber.

When a pressure of the gas in the first working chamber in the first position already exceeds an atmospheric pressure, the overpressure valve opens and this gas is carried off through the passage to the ambient atmosphere even before the first working chamber gets into adjacent contact with the outlet port, thus avoiding further overcompression in the compression chamber and a waste of energy associated therewith.

The overpressure valve applied in JP S61-65087 A is a spring-loaded valve, while the overpressure valve applied in US 2012/0039737 A1 is a weight-loaded valve.

If the element operates without overcompression in the first working chamber in the first position, the spring-loaded valve in JP S61-65087 A keeps the passage closed by means of a spring that pushes a movable part of the valve against a valve seat.

The lower the force with which the spring in such a spring-loaded valve pushes the movable part of the valve against the valve seat, the easier and quicker the spring-loaded valve is opened in the event of overcompression. Yet this has the disadvantage that the spring-loaded valve returns to a closed position more difficultly and slower.

When the element is operating without overcompression in the first working chamber in the first position, the weight-loaded valve in US 2012/0039737 A1 keeps the passage closed by means of a movable part of the valve that pushes with its weight against a valve seat.

The lower the weight with which the movable part of the valve pushes against the valve seat, the easier the weight-loaded valve is opened in the event of overcompression. Yet this has the disadvantage that the weight-loaded valve returns to a closed position more difficultly and slower.

As a consequence of pressure variations in the ambient atmosphere of the vacuum pump element in JP S61-65087 A or US 2012/0039737 A1, the spring-loaded or weight-loaded overpressure valve also starts to vibrate and rattle between a closed and open position, which causes vibrations and noise nuisance in the element.

The present invention aims at solving at least one of the said and/or other disadvantages.

SUMMARY OF THE INVENTION

To this end, the invention relates to an element for compressing a gas, wherein the element comprises a housing with an inlet for gas and an outlet for compressed gas, wherein the housing encloses a compression chamber, which compression chamber is provided in the housing with an inlet port connected to the inlet and an outlet port connected to the outlet, wherein the compression chamber has a rotor rotatably mounted relative to the housing in such a manner that the rotor divides the compression chamber into several working chambers which are arranged successively in a direction from the inlet port to the outlet port and which are mutually sealed or almost sealed, such that on rotation of the rotor in the compression chamber the working chambers are successively created at the inlet port, subsequently move in a direction from the inlet port to the outlet port, are reduced in volume after termination of a fluid contact with the inlet port and eventually get into adjacent contact with the outlet port, wherein the element is provided with a first passage configured to be able to put the outlet in fluid connection with a first working chamber in the compression chamber, which first working chamber is in such a first position that it is not yet in adjacent contact with the outlet port, wherein the first passage is provided with a first overpressure valve configured to open the first passage when a first pressure difference between a pressure in the first working chamber in said first position and a pressure at the outlet exceeds a first preset value and to close it when this first pressure difference is lower than the first preset value, with the characteristic that the first overpressure valve includes a valve body that encloses an internal buffer space with a variable volume that is in fluid connection with the outlet through a constriction, configured so that, upon opening the first passage, this variable volume is reduced and gas is carried from the internal buffer space through the constriction to the outlet, and so that, upon closing the first passage, this variable volume increases, and gas is carried from the outlet through the constriction to the internal buffer space.

In this context, a 'constriction' refers to a structure with a cross section characteristic for the gas flow which is smaller than a cross section characteristic for a gas flow of the internal buffer space.

The internal buffer space with the variable volume and the constriction between the internal buffer space and the outlet have the advantage that an opening or further opening movement of the first overpressure valve is attenuated.

After all, by putting the internal buffer space into fluid connection with the outlet of the element through the constriction, when the overpressure valve opens and the variable volume of the internal buffer space is reduced, a pressure of the gas in the internal buffer space will temporarily increase stronger than the pressure of the gas in the outlet.

This temporarily stronger pressure increase of the gas in the internal space will cause the gas in the internal buffer space to exercise a counteracting force with regard to a further opening of the overpressure valve.

Putting the internal buffer space in fluid connection with the outlet of the element through the constriction will also make the pressure of the gas in the internal buffer space less susceptible to variations in the pressure in the outlet of the element.

That way, the overpressure valve will be less likely to start vibrating and will less often and less loudly rattle, which will reduce or even eliminate vibrations and noise nuisance in the element.

In a preferred embodiment of the element in accordance with the invention, the element is provided with at least one second passage configured to be able to put the outlet into fluid connection with the first working chamber in said first position, wherein the second passage is provided with a second overpressure valve that is configured to open the second passage when the first pressure difference exceeds the first preset value and to close it when the first pressure difference is lower than the first preset value.

By providing the first and the second passage each with an overpressure valve, the load and vibrations associated therewith due to the pressure in the first working chamber or due to pressure variations in the outlet of the element are divided over two overpressure valves, which reduces or even eliminates vibrations and noise nuisance in the element.

In a subsequent preferred embodiment of the element according to the invention, the element is provided with at least one third passage configured to be able to put the outlet in fluid connection with a second working chamber in the compression chamber, which second working chamber is in such a second position that it is not yet in adjacent contact with the outlet port, and which second working chamber differs from the first working chamber, wherein the third passage is provided with a third overpressure valve which is configured to open the third passage when a second pressure difference between a pressure in the second working chamber in said second position and a pressure at the outlet exceeds a second preset value and to close it when this second pressure difference is lower than the second preset value.

Because of the presence of the third passage, in addition to the first and/or second passage, overcompressed gas from the various working chambers which are not yet in fluid contact with the outlet port can be carried from the compression chamber to the outlet.

That way, overcompressed gas in the compression chamber can be carried at various locations from the compression chamber to the outlet.

This is particularly advantageous when factors in the surroundings of the element are variable and where, consequently, a position in the compression chamber where overcompression of the gas occurs first is variable as well.

In a more preferred embodiment of the element in accordance with the invention, the element is provided with at least one fourth passage configured to be able to put the outlet into fluid connection with the second working chamber in said second position, wherein the fourth passage is provided with a fourth overpressure valve that is configured to open the fourth passage when the second pressure difference exceeds the second preset value and to close it when the second pressure difference is lower than the second preset value.

By providing the third and the fourth passages each with an overpressure valve, the load and vibrations associated therewith due to the pressure in the second working chamber or as a consequence of pressure variations in the outlet of the element are divided over two overpressure valves, which reduces or even eliminates vibrations and noise nuisance in the element.

Preferentially, the first pressure difference and the second pressure difference are equal or almost equal.

This way, an identical or similar valve is used for all overpressure valves in the element according to the invention, for instance a spring-loaded valve with an identical spring and, consequently, an identical spring strength for every overpressure valve in the element.

This makes repairs or maintenance of the element easier because only one type of valve is required.

In another preferred embodiment of the element according to the invention, the element is vacuum pump element.

For a vacuum pump element, the outlet has an outlet pressure that is equal to the atmospheric pressure increased by a usually limited pressure drop across an outlet system downstream of the outlet, to which outlet pressure also the overpressure valves of the vacuum pump element are then exposed.

As a result, in such a vacuum pump element an identical standard overpressure valve can be used, while for a compressor element the one or several overpressure valves must specifically be selected in accordance with a user-prescribed and possibly variable end pressure of the compressed gas at the outlet of the element.

In another preferred embodiment of the element according to the invention, the element is a screw element.

In a screw element, the rotor in the compression space is a screw rotor. Usually, the compression space of a screw element even has two intermeshing screw rotors with opposite pitch.

The compression chamber in a screw element is subdivided in an axial direction from the inlet port to the outlet port into working chambers according to the pitch of the screw rotor or the screw rotors.

On the basis of this pitch, a correct position of the first passage in said axial direction can be determined to make the first passage end at a working chamber in the compression chamber which is not yet in fluid contact with the outlet port.

In another preferred embodiment of the element according to the invention, the element is a liquid-injected element.

A liquid-injected element is an element in which liquid is injected into the compression chamber of the element.

The injected liquid ensures the sealing of the clearances between the rotor and a wall of the compression chamber such that the working chambers in the compression chamber are mutually sealed or almost sealed without the rotor and the wall of the compression chamber having to touch each other, which could cause energy losses in the element due to friction and/or could result in damage to the rotor and/or wall of the compression chamber.

Moreover, the injected liquid can be used for cooling the gas in the compression chamber, which gas would heat up without this cooling because of the compression heat during the compression. This cooling can protect the element against high temperature peaks in the element due to overcompression of the gas. Compression of the gas in the compression chamber is also carried out more energy-efficiently when a temperature of the gas in the compression chamber increases less for a same pressure increase.

In another preferred embodiment of the element according to the invention, the first overpressure valve is a spring-loaded valve.

In this context, 'spring-loaded valve' refers to the fact that, for closing the first overpressure valve, the first overpressure valve comprises a separate spring and/or that the first overpressure valve is at least partly made of springy material.

A spring force of the spring or the springy material closes the first overpressure valve when the first pressure difference between the pressure in the first working chamber that is in fluid contact with the first overpressure valve and the pressure at the outlet is below the first preset value.

In a subsequent preferred embodiment of the element according to the invention, the first passage is provided with a valve seat, wherein the first overpressure value comprises a valve base that is configured to be mounted in the housing, and wherein the first overpressure valve comprises a part that can move relative to the valve base and that is configured to make contact with the valve seat and, consequently, close the first passage.

The valve base ensures a firm mounting of the first overpressure valve in the housing, while the movable part lends flexibility to the first overpressure valve to be able to open or close the first passage.

In a more preferred embodiment of the element according to the invention, the valve base is configured to be removably mounted in the housing.

As a result, the first overpressure valve in the element can easily be removed for replacement, maintenance, or repairs.

Moreover, that way the element can easily be modified by installation of a specifically modified first overpressure valve that opens the first passage above a specifically desired value of the first pressure difference between the pressure in the first working chamber in said first position and the pressure at the outlet.

In a subsequent more preferred embodiment of the element according to the invention, the valve seat and/or the movable part are provided with an O-ring for sealing the first passage.

Such an O-ring is an easy-to-manufacture and fairly reliable component that can easily be installed and replaced.

Alternatively, or in addition, the valve seat and/or the movable part can be provided with an embedded piece of elastic material for sealing the first passage.

Such an embedded piece of elastic material is generally more robust and less susceptible to damage, such as tearing, than a separate O-ring.

Preferentially, the elastic material is a vulcanized rubber.

In another preferred embodiment of the element according to the invention, the constriction is provided in the valve base.

As a result, the constriction does not have to be integrated as a channel in the housing of the element.

Integrating the constriction as a channel in the housing of the element could require complicated machining of the housing and would reduce the mechanical strength of the housing.

In a subsequent preferred embodiment of the element according to the invention, the constriction has a smallest diameter which is smaller, in a direction perpendicular to a direction in which the first overpressure valve opens or closes, than the largest dimension of the internal buffer space.

Preferably, a maximum ratio between a smallest diameter of the constriction and a largest dimension of the internal buffer space does not exceed 10%.

This maximum ratio ensures that an opening or further opening movement of the first overpressure valve can be attenuated to a certain degree.

In a more preferred embodiment of the element according to the invention, a minimum ratio between said smallest diameter of the constriction and said largest diameter of said internal buffer space is not lower than 4%.

This minimum ratio ensures that an opening or further opening movement of the first overpressure valve can take place to a certain degree despite the fact that this movement is attenuated.

In addition, the invention relates to an overpressure valve for use in an element according to one of the above-described embodiments of the element according to the invention.

It goes without saying that such an overpressure valve contributes to the advantages as described for the above-described embodiments of the element according to the invention.

In addition, the invention relates to a device for compressing gas provided with an element according to one of the above-described embodiments of the element according to the invention.

It goes without saying that such a device offers the same advantages as the advantages of the above-described embodiments of the element according to the invention.

Finally, the invention also relates to a method for controlling an element for compressing a gas, wherein the element comprises a housing with an inlet for gas and an outlet for compressed gas, wherein the housing encloses a compression chamber, which compression chamber is provided in the housing with an inlet port connected to the inlet and an outlet port connected to the outlet, wherein the compression chamber is divided by means of a rotor into several, in a direction from the inlet port to the outlet port, successive and mutually sealed or almost sealed working chambers, wherein on rotation of the rotor in the compression chamber the working chambers are successively created at the inlet port, subsequently move in a direction from the inlet port to the outlet port, are reduced in volume after termination of a fluid contact with the inlet port, and eventually get into adjacent contact with the outlet port, wherein the element is provided with a first passage configured to be able to put the outlet in fluid connection with the first working chamber in the compression chamber, which first working chamber is in a first position at which it is not yet in adjacent contact with the outlet port, wherein the first passage is opened by means of a first overpressure valve in the first passage when a first pressure difference between a pressure in the first working chamber in said first position and a pressure at the outlet exceeds a first preset value and is closed when this first pressure difference is lower than the first preset value, with the characteristic that, upon opening the first passage, a variable volume of an internal buffer space enclosed by a valve body of the first overpressure valve is reduced, and gas carried from this internal buffer space is through a constriction to the outlet, and upon closing the first passage, the variable volume increases, and gas is carried from the outlet through the constriction to the internal buffer space.

It goes without saying that such a method offers the same advantages as the advantages for the above-described embodiments of the element according to the invention.

BRIEF DESCRIPTION OF THE DRAWINGS

To better demonstrate the features of the invention, the following describes, as an example without any restrictive character, a preferred embodiment of an element according to the invention, with reference to the accompanying drawings, wherein.

DETAILED DESCRIPTION

The terminology used is intended only to describe the preferred embodiment by way of example and must not be interpreted as limiting for the scope of protection as defined in the claims.

Expressing terms in the singular, preceded by "a/an" or "the", does not exclude that these terms may be present in the plural in the invention, except where defined otherwise.

Although the terms "first", "second", "third" or "fourth" are used below to refer to various working chambers, positions, passages, overpressure valves or preset values, these working chambers, positions, passages, overpressure valves or preset values are not limited to these terms. At most, these terms have only been used to distinguish a type of working chamber, position, passage, overpressure valve or preset value. When terms such as "first", "second", "third" or "fourth" are used in the following, these terms do not imply any particular sequence or order. Consequently, a first working chamber, position, passage, overpressure valve or preset value could just as easily be designated as, for example, a second or third working chamber, position, passage, overpressure valve or preset value without in that case going beyond the scope of the example embodiments. It should also be mentioned that there may be more first, second, third or fourth working chambers, positions, passages, overpressure valves or preset values.

Figure 1:
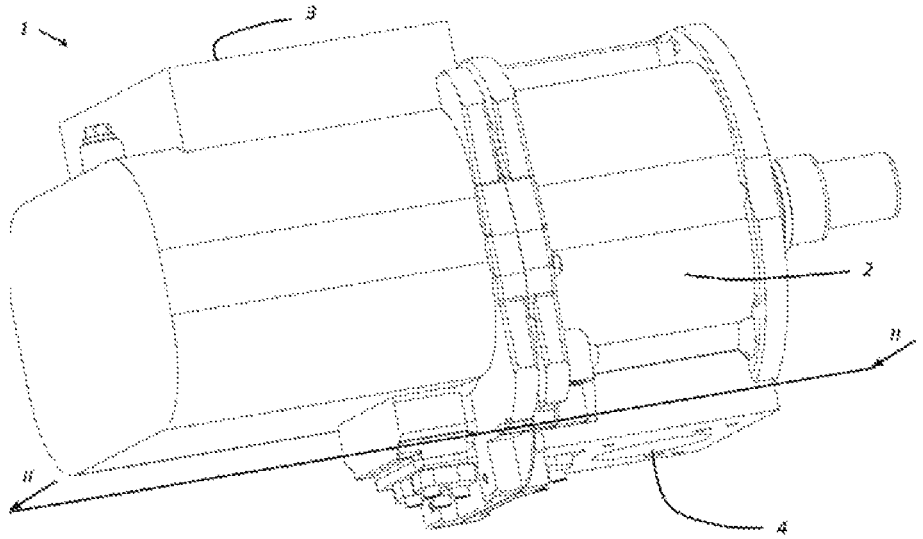
FIG. 1 shows, in perspective, an element according to the invention.

FIG. 1 shows an element 1 for compressing gas, which element 1 comprises a housing 2 with an inlet 3 for gas and an outlet 4 for compressed gas.

Figure 2:
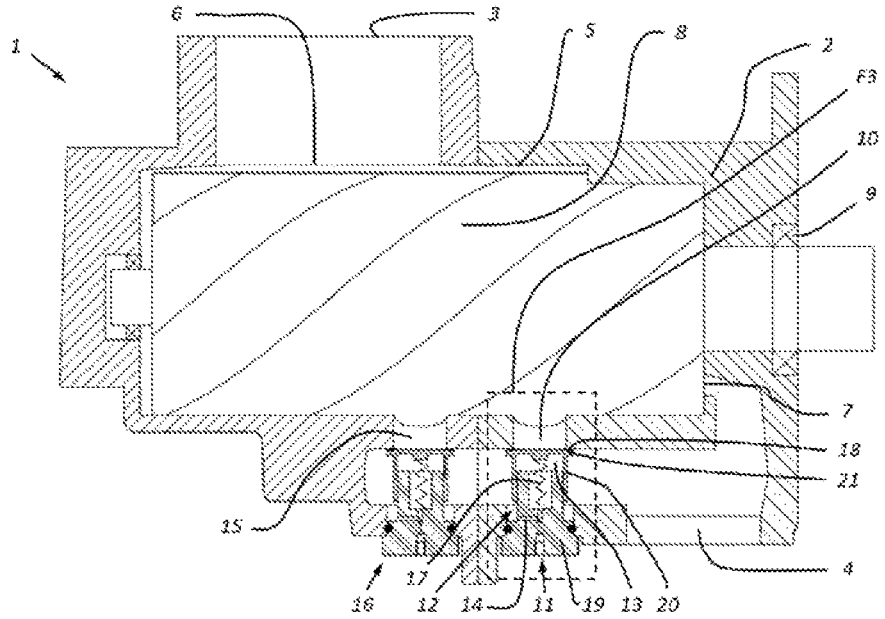
FIG. 2 shows a cross-section according to line II-II in FIG. 1.

FIG. 2 shows a cross-section of the element 1 according to line II-II in FIG. 1.

This cross-section reveals that housing 2 encloses a compression chamber 5 which compression chamber 5 is provided with an inlet port 6 which is coupled in fluid connection to the inlet 3 and an outlet port 7 which is coupled in fluid connection to the outlet 4.

In compression chamber 5, a rotor 8 is rotatably mounted relative to the housing 2 in such a manner that the rotor 8 divides the compression chamber 5 into several working chambers which are arranged successively in a direction from the inlet port 6 to the outlet port 7 and which are almost mutually sealed.

In this case, rotor 8 is designed as a screw rotor. In other words, element 1 is a screw element.

In this case, but not necessary for the invention, rotor 8 is rotatably mounted to housing 2 by means of bearings 9.

On rotation of the rotor 8 in the compression chamber 5, the working chambers 8 are successively created at the inlet port 6, subsequently move in a direction from the inlet port 6 to the outlet port 7, are reduced in volume after termination of a fluid contact with the inlet port 6 and eventually get into adjacent contact with the outlet port 7.

The element 1 is provided with a first passage 10 configured to be able to put the outlet 4 in fluid connection with a first working chamber in the compression chamber 5, which first working chamber is in such a first position that it is not yet in adjacent contact with the outlet port 7.

The first passage 10 is provided with a first overpressure valve 11 configured to open the first passage 10 when a first pressure difference between a pressure in the first working chamber in said first position and a pressure at the outlet 4 exceeds a first preset value and to close it when this first pressure difference is lower than the first preset value.

The first overpressure valve 11 includes a valve body 12 that encloses an internal buffer space 13 with a variable volume that is in fluid connection with the outlet 4 through a constriction 14.

Upon opening the first passage 10, the variable volume of the internal buffer space 13 is reduced, and gas from the internal buffer space 13 is carried through the constriction 14 to the outlet 4.

Upon closing the first passage 10, the variable volume of the internal buffer space 13 increases, and gas from the outlet 4 is carried through the constriction 14 to the internal buffer space 13.

The element 1 may be provided with a second passage (not shown in FIG. 2) configured to be able to put outlet 4 in fluid connection with the first working chamber in the compression chamber 5 when this first working chamber is in said first position.

Similar to the first passage 10, the second passage could be provided with a second overpressure valve with which the second passage is opened when the first pressure difference exceeds the first preset value and is closed when this first pressure difference is below the first preset value.

In the framework of the invention, it is not excluded that the outlet 4 can be put in fluid connection through more than two passages having one or several overpressure valves with the first working chamber in said first position.

In this case, but not necessary for the invention in general, the element 1 is provided with a third passage 15 which is configured to be able to put outlet 4 in fluid connection with a second working chamber in the compression chamber 5, which second working chamber is in such a second position that it is not yet in adjacent contact with the outlet port 7 and which second working chamber differs from said first working chamber.

The third passage 15 is provided with a third overpressure valve 16 with which the third passage 15 is opened when a second pressure difference between a pressure in the second working chamber in said second position and the pressure at the outlet 4 exceeds a second preset value and is closed when this second pressure difference is below the second preset value.

The element 1 may be provided with a fourth passage (not shown in FIG. 2) configured to be able to put outlet 4 in fluid connection with the second working chamber in said second position.

Similar to the first passage 15, the fourth passage could be provided with a fourth overpressure valve with which the fourth passage is opened when the second pressure difference exceeds the second preset value and is closed when the second pressure difference is below the second preset value.

In the framework of the invention it is not excluded that the outlet 4 can be put into fluid connection through more than two passages having one or several overpressure valves with the second working chamber in said second position.

Neither is it excluded in the framework of the invention that the element comprises at least one more passage which is configured to be able to put outlet 4 in fluid connection with at least one working chamber in the compression chamber 5, wherein this at least one working chamber is in such a third position that it has not yet been in adjacent contact with the outlet port 7 and this at least one working chamber differs from said first and second working chambers.

In this case the first overpressure valve 11 and the third overpressure valve 16 are designed as a spring-loaded valve, wherein the first overpressure valve 11 and the third overpressure valve 16 are closed by means of a spring force of a spring 17 when respectively the first or second pressure difference between the pressure of the gas in respectively the first or second working chamber in respectively the first or second position and the pressure at the outlet 4 is below respectively the first or second preset values.

In the framework of the invention it is not excluded that one of said overpressure valves in one of said passages does not comprise a spring, but is at least partially composed of a springy or elastic material, in which said springy or elastic material can deliver sufficient spring force for closing this overpressure valve at a pressure difference between a pressure in a working chamber in the compression chamber with which the passage is in fluid contact and a pressure at the outlet that is below a preset value.

Neither is it excluded in the framework of the invention that one of said overpressure valves in the element is a different type of valve, such as for instance a weight-loaded valve.

In this case the first passage 10 and the third passage 15 are provided with a valve seat 18, wherein respectively the first overpressure valve 11 and the third overpressure valve 16 comprise a valve base 19 which is configured to be mounted in the housing 2.

The first overpressure valve 11 and the third overpressure valve 16 comprise a part 20 that is movable relative to the valve base 19 that is configured to make contact with the valve seat and as such to close the first passage 10 or the third passage 15, respectively.

Here the movable part 20 is provided with an O-ring 21 for sealing the first passage 10.

In the framework of the invention it is not excluded that the O-ring 21 is provided on the valve seat 18, or that both the movable part 20 and the valve seat 18 are provided with an O-ring, or that the movable part 20 and/or the valve seat 18 are provided with several O-rings.

Neither is it excluded in the framework of this invention that, as an alternative or addition to the above-described O-ring, the movable part 20 and/or the valve seat 18 are provided with an embedded piece of elastic material for sealing the first passage 10 or the third passage 15. Preferentially, this embedded piece of elastic material is made of vulcanized rubber.

In this case the constriction 14 is provided in the valve base 19.

In this case the constriction 14 is also provided as a whole in the valve base 19 rather than in the housing 2 of the element 1.

However, in the framework of the invention it is not excluded that the constriction is at least partly provided in the housing 2.

Figure 3:
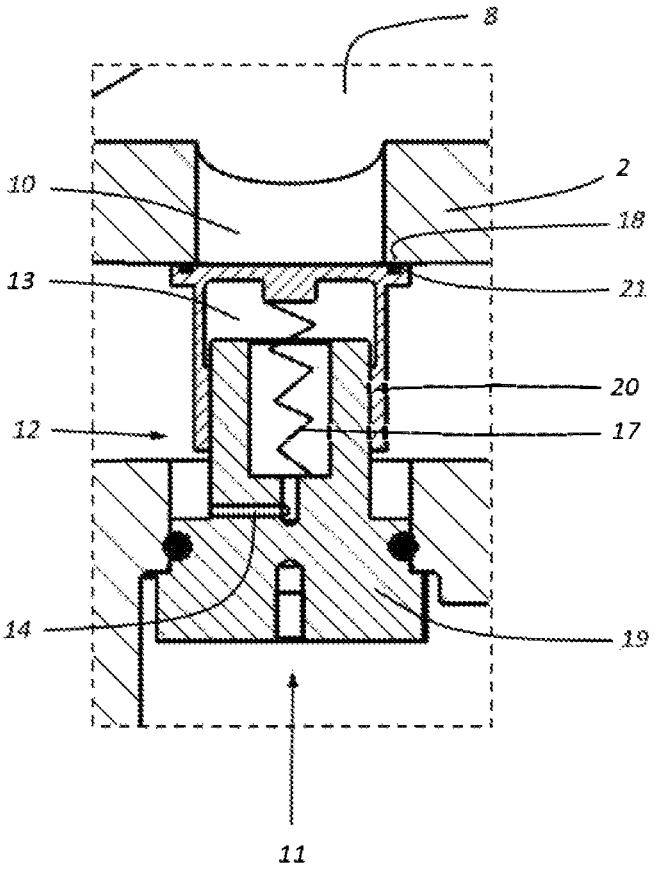
FIG. 3 shows a part indicated as F3 in FIG. 2 in more detail.

FIG. 3 shows in more detail the first overpressure valve 11 in a part that is identified in FIG. 2 as F3.

The current invention is by no means limited to the embodiment described as example and shown in the figures, but an element according to the invention can be implemented in all shapes and sizes without going beyond the scope of the invention as defined in the claims.

The invention claimed is:

1. An element for compressing a gas, wherein the element (1) comprises a housing (2) with an inlet (3) for gas and an outlet (4) for compressed gas, wherein the housing (2) encloses a compression chamber (5), which compression chamber (5) is provided in the housing (2) with an inlet port (6) connected to the inlet (3) and an outlet port (7) connected to the outlet (4), wherein the compression chamber (5) has a rotor (8) rotatably mounted relative to the housing (2) in such a manner that the rotor (8) divides the compression chamber (5) into several working chambers which are arranged successively in a direction from the inlet port (6) to the outlet port (7) and which are mutually sealed or almost sealed, such that on rotation of the rotor (8) in the compression chamber (5) the working chambers are successively created at the inlet port (6), subsequently move in a direction from the inlet port (6) to the outlet port (7), are reduced in volume after termination of a fluid contact with the inlet port (6), and eventually get into adjacent contact with the outlet port (7), wherein the element (1) further comprises a first passage (10) configured to be able to put the outlet (4) in fluid connection with a first working chamber in the compression chamber (5), which first working chamber is in such a first position that it is not yet in adjacent contact with the outlet port (7), wherein the first passage (10) includes a first overpressure valve (11) configured to open the first passage (10) when a first pressure difference between a pressure in the first working chamber in said first position and a pressure at the outlet (4) exceeds a first preset value and to close it when this first pressure difference is lower than the first preset value, wherein the first overpressure valve (11) includes a valve body (12) that encloses an internal buffer space (13) with a variable volume that is in fluid connection with the outlet (4) through a constriction (14), configured so that, upon opening the first passage (10), this variable volume is reduced and gas is carried from the internal buffer space (13) through the constriction (14) to the outlet (4), and so that, upon closing the first passage (10), this variable volume increases, and gas is carried from the outlet (4) through the constriction (14) to the internal buffer space (13).

2. The element according to claim 1, wherein the element (1) further comprises a second passage configured to be able to put the outlet (4) in fluid connection with the first working chamber in said first position, wherein the second passage includes a second overpressure valve configured to open the second passage when the first pressure difference exceeds the first preset value and to close it when the first pressure difference is lower than the first preset value.

3. The element according to claim 1, wherein the element (1) further comprises a third passage (15) configured to be able to put the outlet (4) in fluid connection with a second working chamber in the compression chamber (5), which second working chamber is in such a second position that it is not yet in adjacent contact with the outlet port (7) and which second working chamber differs from the first working chamber, wherein the third passage (15) includes a third overpressure valve (16) configured to open the third passage (15) when a second pressure difference between a pressure in the second working chamber in said second position and a pressure at the outlet (4) exceeds a second preset value and to close it when this second pressure difference is lower than the second preset value.

4. The element according to claim 3, wherein the element (1) further comprises a fourth passage configured to be able to put the outlet (4) into fluid connection with the second working chamber in said second position, wherein the fourth passage includes a fourth overpressure valve configured to open the fourth passage when a second pressure difference exceeds a second preset value and to close it when the second pressure difference is lower than the second preset value.

5. The element according to claim 3, wherein the first pressure difference and the second pressure difference are equal or almost equal.

6. The element according to claim 1, wherein the element (1) is a vacuum pump element.

7. The element according to claim 1, wherein the element (1) is a screw element.

8. The element according to claim 1, wherein the element (1) is a liquid-injected element.

9. The elements according to claim 1, wherein the first overpressure valve (11) is a spring-loaded valve.

10. The element according to claim 1, wherein the first passage (10) includes a valve seat (18), wherein the first overpressure valve (11) comprises a valve base (19) configured to be mounted in the housing (2), and wherein the first overpressure valve (11) comprises a part (20) that is movable relative to the valve base (19) and that is configured to make contact with the valve seat (18) and as such to close the first passage (10).

11. The element according to claim 10, wherein the valve base (19) is configured to be removably mounted in the housing (2).

12. The element according to claim 10, wherein the valve seat (18) and/or the movable part (20) are provided with an O-ring (21) for sealing the first passage (10).

13. The element according to claim 10, wherein the valve seat (18) and/or the movable part (20) are provided with an embedded piece of elastic material for sealing the first passage (10).

14. The element according to claim 13, wherein the elastic material is a vulcanized rubber.

15. The element according to claim 10, wherein the constriction (14) is provided in the valve base (19).

16. The element according to claim 1, wherein the constriction (14) has a smallest diameter which is smaller, in a direction perpendicular to a direction in which the first overpressure valve opens or closes, than a largest dimension of the internal buffer space (13).

17. The element according to claim 16, wherein a maximum ratio between said smallest diameter of the constriction (14) and said largest dimension of the internal buffer space (13) does not exceed 10%.

18. The element according to claim 16, wherein a minimum ratio between said smallest diameter of the constriction (14) and said largest dimension of said internal buffer space (13) is not lower than 4%.

19. A method for controlling an element for compressing a gas, wherein the element (1) comprises a housing (2) with an inlet (3) for gas and an outlet (4) for compressed gas, wherein the housing (2) encloses a compression chamber (5), which compression chamber (5) is provided in the housing (2) with an inlet port (6) connected to the inlet (3) and an outlet port (7) connected to the outlet (4), wherein the compression chamber (5) is divided by means of a rotor (8) into several, in a direction from the inlet port (6) to the outlet port (7), successive and mutually sealed or almost sealed working chambers, wherein on rotation of the rotor (8) in the compression chamber (5) the working chambers are successively created at the inlet port (6), subsequently move in a direction from the inlet port (6) to the outlet port (7), are reduced in volume after termination of a fluid contact with the inlet port (6), and eventually get into adjacent contact with the outlet port (7), wherein the element (1) is provided with a first passage (10) configured to be able to put the outlet (4) in fluid connection with the first working chamber in the compression chamber (5), which first working chamber is in a first position at which it is not yet in adjacent contact with the outlet port (7), wherein the first passage (10) is opened by means of a first overpressure valve (11) in the first passage (10) when a first pressure difference between a pressure in the first working chamber in said first position and a pressure at the outlet (4) exceeds a first preset value and is closed when the first pressure difference is lower than the first preset value, wherein the method comprises:

upon opening the first passage (10), a variable volume of an internal buffer space (13) enclosed by a valve body (12) of the first overpressure valve (11) is reduced, and gas is carried from this internal buffer space (13) through a constriction (14) to the outlet (4), and upon closing the first passage (10), the variable volume increases, and gas is carried from the outlet (4) through the constriction (14) to the internal buffer space (13).

* * * * *